US010115546B2

(12) United States Patent
Rodrigues et al.

(10) Patent No.: US 10,115,546 B2
(45) Date of Patent: Oct. 30, 2018

(54) ELECTRICAL TRIPOUT DEVICE INTEGRATING A CIRCUIT BREAKER AND AN ISOLATOR

(71) Applicant: General Electric Technology GmbH, Baden (CH)

(72) Inventors: Didier Rodrigues, Serpaize (FR); Denis Frigiere, Decines (FR); Jean Marc Willieme, La Mulatiere (FR); Frank Jacquier, Mions (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 15/532,195

(22) PCT Filed: Dec. 1, 2015

(86) PCT No.: PCT/EP2015/078138

§ 371 (c)(1),
(2) Date: Jun. 1, 2017

(87) PCT Pub. No.: WO2016/087406

PCT Pub. Date: Jun. 9, 2016

(65) Prior Publication Data

US 2017/0338067 A1 Nov. 23, 2017

(30) Foreign Application Priority Data

Dec. 2, 2014 (FR) ..... 14 61804

(51) Int. Cl.
*H01H 33/04* (2006.01)

(52) U.S. Cl.
CPC ..... *H01H 33/04* (2013.01)

(58) Field of Classification Search
CPC ..... H01H 33/91; H01H 9/443; H01H 33/42; H01H 9/342; H01H 9/36; H01H 33/08;
(Continued)

(56) References Cited

U.S. PATENT DOCUMENTS 4,900,882 A * 2/1990 Bernard ..... H01H 33/982 218/26
5,610,381 A * 3/1997 Mizufune ..... H01H 33/16 218/57

(Continued)

FOREIGN PATENT DOCUMENTS

DE 198 59 007 A1 6/2000
EP 0 877 405 A1 11/1998

(Continued)

OTHER PUBLICATIONS

Search Report issued in French Patent Application No. 14 61804 dated Jul. 29, 2015.

(Continued)

*Primary Examiner* — Truc Nguyen
(74) *Attorney, Agent, or Firm* — Pearne & Gordon LLP

(57) ABSTRACT

A current-interrupter device (1) comprising a circuit breaker (2) including a first stationary conductive support (4) carrying both a stationary arcing contact (14) and a movable arcing contact (16), and also carrying a movable permanent contact (17), the movable arcing contact (16) and the movable permanent contact (17) being electrically connected to the first stationary support (4), and a disconnector (3) including a second stationary conductive support (6) carrying a disconnector contact (18), and wherein:

the movable disconnector contact (18) is in contact with the stationary arcing contact (14) when it is closed and spaced apart from the stationary arcing contact (14) when it is open; and the movable disconnector contact (18) and the movable permanent contact (17) are connected to each other when they are both in the closed position, and they are spaced apart from each other when one or the other is open.

6 Claims, 2 Drawing Sheets

(58) Field of Classification Search
CPC ..... H01H 33/22; H01H 33/666; H01H 33/12; H01H 33/596; H01H 33/64; H01H 33/7023; H01H 33/88; H01H 73/18; H01H 1/385
See application file for complete search history.

(56) References Cited

U.S. PATENT DOCUMENTS

| | | | | |
|---|---|---|---|---|
| 5,742,017 | A * | 4/1998 | Perret | H01H 33/166 218/143 |
| 5,814,782 | A * | 9/1998 | Muller | H01H 33/166 218/143 |
| 5,850,065 | A * | 12/1998 | Yaginuma | H01H 33/74 218/43 |
| 5,859,399 | A * | 1/1999 | Perret | H01H 33/905 218/60 |
| 5,898,151 | A | 4/1999 | Plat | |
| 5,952,635 | A | 9/1999 | Plat | |
| 6,013,888 | A | 1/2000 | Thuries | |
| 2004/0004796 | A1* | 1/2004 | Tresy | H01H 33/143 361/62 |
| 2008/0290069 | A1* | 11/2008 | Dufournet | H01H 33/901 218/59 |
| 2010/0193474 | A1* | 8/2010 | Rostron | H01H 33/24 218/124 |
| 2012/0103940 | A1* | 5/2012 | Ohda | H01H 33/166 218/50 |
| 2012/0292291 | A1* | 11/2012 | Kaulfuss | H01H 33/24 218/149 |
| 2013/0020286 | A1* | 1/2013 | Yeon | H01H 33/904 218/63 |
| 2015/0318124 | A1 | 11/2015 | Rodrigues | |

FOREIGN PATENT DOCUMENTS

| | | | |
|---|---|---|---|
| EP | 0 878 817 | A1 | 11/1998 |
| EP | 0 913 845 | A1 | 5/1999 |
| EP | 1 921 646 | A2 | 5/2008 |

OTHER PUBLICATIONS

International Preliminary Report on Patentability issued in Application No. PCT/EP2015/078138 dated Nov. 15, 2016.
International Search Report issued in Application No. PCT/EP2015/078138 dated Jan. 15, 2016.
Written Opinion issued in Application No. PCT/EP2015/078138 dated Jan. 15, 2016.

* cited by examiner

ELECTRICAL TRIPOUT DEVICE INTEGRATING A CIRCUIT BREAKER AND AN ISOLATOR

TECHNICAL FIELD

The invention relates to interrupting electrical current in an installation of the medium- or high-voltage type.

STATE OF THE PRIOR ART

An electrical installation of the high- or medium-voltage type typically comprises two types of switchgear: circuit breakers and disconnectors.

A disconnector includes a single set of contacts comprising a stationary disconnector contact and a movable disconnector contact, through which current flows when the disconnector is closed.

When the disconnector is open, the disconnector contacts are separated by a distance enabling the disconnector to present a certain strength, i.e. a determined dielectric strength.

A circuit breaker includes a set of permanent contacts mounted in parallel with a set of arcing contacts. The arcing contacts are in an enclosure containing a dielectric gas such as $SF_6$ promoting the extinction of an electric arc that forms between said arcing contacts when the circuit breaker opens.

Since the arcing contacts cannot pass a rated current for too long, they are used only during a stage in which the circuit breaker is being operated. In normal operation, when the circuit breaker is closed, the permanent contacts are thus closed so that the rated current passes mainly via the permanent contacts. During the opening operation, the permanent contacts are opened before opening of the arcing contacts.

A circuit breaker and a disconnector are generally used in series in order to combine the characteristics and advantages of each kind of equipment: the breaking power of the circuit breaker and the dielectric strength of the disconnector.

The object of the invention is to propose a new arrangement of this type of equipment.

SUMMARY OF THE INVENTION

The invention provides a current-interrupter device comprising a circuit breaker including a first stationary conductive support carrying both a stationary arcing contact and a movable arcing contact that is movable between a closed position and an open position, and also carrying a movable permanent contact that is movable between a closed position and an open position, the movable arcing contact and the movable permanent contact being electrically connected to the first stationary support, and a disconnector including a second stationary conductive support carrying a disconnector contact that is movable between a closed position and an open position, and wherein:

- the movable disconnector contact is in contact with the stationary arcing contact when it is closed;
- the movable disconnector contact is spaced apart from the stationary arcing contact when it is open;
- the movable disconnector contact and the movable permanent contact are connected to each other when they are both in the closed position; and
- the movable disconnector contact and the movable permanent contact are spaced apart from one another when one or the other is open.

With this arrangement, the current-interrupter device jointly constitutes a circuit breaker and a disconnector, thereby presenting a reduced number of components so as to offer two functions in one. The permanent movable contact also acts as a stationary contact of the disconnector, and in analogous manner, the movable disconnector contact also acts as a stationary permanent contact.

The invention also provides a device as described above, wherein the movable arcing contact and the movable permanent contact are dynamically linked together in order to move together in such a manner that when the movable disconnector contact is closed, during a movement of the movable arcing contact and of the movable permanent contact from the closed position to the open position, the movable permanent contact is disconnected from the movable disconnector contact before the movable arcing contact disconnects from the stationary arcing contact.

The invention also provides a device as described above, wherein the movable arcing contact and the movable permanent contact are dynamically linked together by forming a single movable unit.

The invention also provides a device as described above, wherein the permanent movable contact has a hollow body of revolution surrounding the stationary arcing contact and the movable arcing contact while being slidably mounted relative to the first stationary support that carries it.

The invention also provides a device as described above, wherein the movable disconnector contact has a body of revolution and is slidably mounted relative to the second movable support by including a tubular portion for connection to the permanent movable contact and a central pin for connection to the stationary arcing contact.

The invention also provides a device as described above, wherein firstly the components of the circuit breaker and secondly the components of the disconnector are spaced apart when all of the contacts are open by a distance that allows a screen to be inserted between the circuit breaker and the disconnector.

The invention also provides a device as described above, fitted with a screen that is inserted into the gap separating the components of the circuit breaker and the components of the disconnector when the contacts are open.

DETAILED DESCRIPTION OF PARTICULAR EMBODIMENTS

Figure 1:
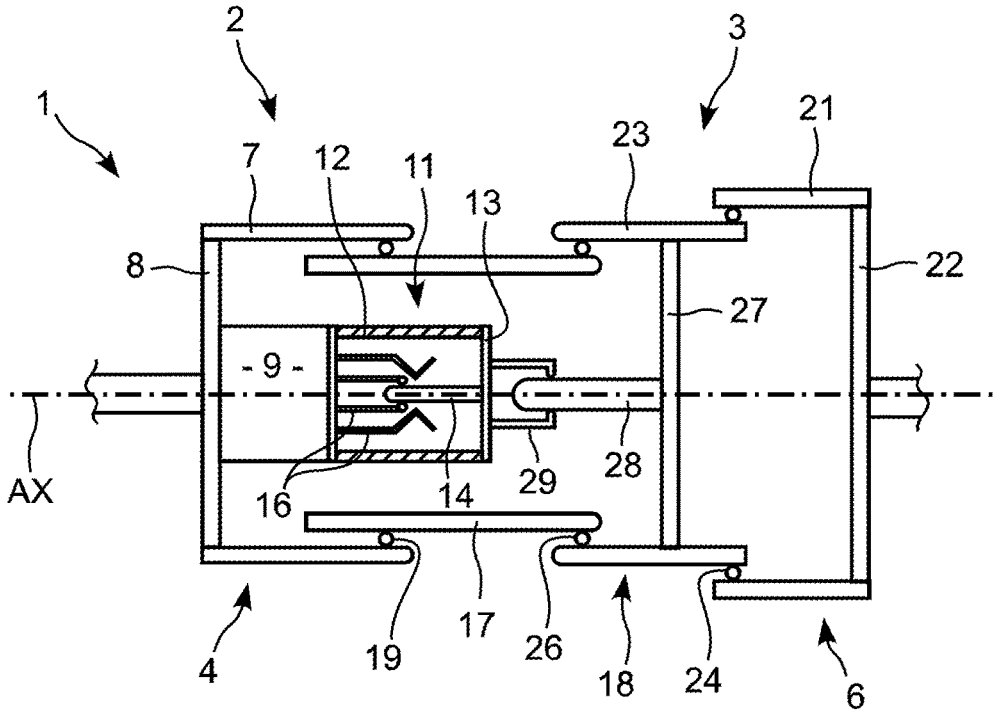
FIG. 1 is a diagrammatic side view in section of the device of the invention in the closed state.

As can be seen in FIG. 1, the current-interrupter device 1 of the invention has a body of revolution about an axis AX that corresponds to its longitudinal axis. It includes a portion forming an electrical circuit breaker, given reference 2 and situated in the left-hand portion of the figures, and a part forming an electrical disconnector, given reference 3 and situated in the right-hand portion of the figures.

This device includes a first stationary support 4, situated on the same side as the circuit breaker part, and a second stationary support 6, situated on the same side as the disconnector part. When the current-interrupter device 1 is in place while being interposed between two segments of a conductive line, the stationary supports 4 and 6 are electrically connected to respective segments of the line.

The stationary support 4 comprises a tubular portion 7 having its end closed by a flat end wall 8 that carries a base plate 9 on its inside face, which base plate carries an arc-control shell 11, the base plate and the shell thus being surrounded by the tubular portion 7.

This shell 11 defines a leaktight enclosure containing a dielectric gas such as $SF_6$, and it contains a movable arcing contact and a stationary arcing contact, which are the contacts between which an electric arc may be formed during a stage of opening the circuit breaker.

The shell 11 comprises a cylinder 12 having one of its ends carried by the base plate 9 and its other end closed by a shell end wall 13 that carries the stationary arcing contact 14 on its inside face, i.e. its face that is directed towards the inside of the shell.

This stationary arcing contact 14 is a rectilinear pin extending in the cylinder 12 towards the base plate 9, and presents a convex free end that is situated substantially half way along the cylinder 12.

The movable arcing contact, which is given reference 16, is carried by the base plate 9 while being movable in translation along the axis AX inside the shell and while being electrically connected to the stationary support 4. It comprises both a tubular portion having an end that surrounds the stationary arcing contact 14 in order to establish electrical contact in the closed position as in FIG. 1, and also a nozzle surrounding said tubular portion.

In the closed position as in FIG. 1, the movable arcing contact 16 is thus deployed inside the shell so as to surround the stationary arcing contact 14 by gripping it in order to be in electrical contact therewith. In contrast, in the open position as in FIG. 2, this movable arcing contact 16 is retracted so as to be remote from the stationary arcing contact 14.

During opening of the circuit breaker, the movable arcing contact 16 is moved in translation so as to pass from its closed position in which it is deployed, to its open position in which it is retracted. When the arcing contacts 14 and 16 separate during this movement, an electric arc is established between them, and in particular as a result of the presence of $SF_6$ insulating gas, said arc disappears before the end of the opening movement.

When the circuit breaker is closed again, its arcing contacts are brought closer together until they establish electrical contact when the movable arcing contact 16 reaches its closed position.

In service, the entire rated current does not pass in the arcing contacts, since it would damage them in the long term. The circuit breaker thus includes a movable contact referred to as a "permanent" contact, and via which most of the line current passes when the circuit breaker is closed and is not being operated.

In this example, the movable permanent contact, which is given reference 17, has the shape of tube that slides inside the tubular portion 7 of the stationary support 4 in order to be movable in translation between a closed position and an open position.

In the closed position corresponding to FIG. 1, the movable permanent contact 17 is deployed in order to be in electrical contact with another contact given reference 18. In the open position corresponding to FIG. 2, the movable permanent contact 17 is retracted in the tubular portion 7 in order to be spaced apart from the other contact 18.

The movable permanent contact 17 is electrically connected to the tubular portion 7 in which it slides by means of a sliding contact 19 that is carried by the inside face of the tubular portion 7 in the end region of said tubular portion 7. The movable permanent contact 17 is thus electrically connected to the stationary support 4 whatever the position it occupies.

In addition, the movable permanent contact 17 and the movable arcing contact 16 are linked together dynamically by mechanical elements that are not shown, and in this example they form a single movable unit.

In order to open the circuit breaker, when this unit is moved from its closed position to its open position, the movable permanent contact is disconnected from the contact 18 before the movable arcing contact 16 disconnects from the stationary arcing contact 14. The arc thus cannot be formed at the permanent contact, but only at the arcing contacts.

In the example shown in the figures, this order of disconnection is ensured by a suitable choice of lengths and positions for the movable permanent contact 17 relative to the contact 18, and for the movable arcing contact 16 relative to the stationary arcing contact 14. More concretely, when the unit is in the closed position, the insertion length of the stationary arcing contact 14 inside the movable arcing contact 16 is longer than the insertion length of the movable permanent contact inside the contact 18.

Another possibility may consist in providing for the movable arcing contact 16 and the movable permanent contact 17 to be movable independently of each other, and for them to be operated one after the other by means of a control system or operating procedure for the device.

The other contact, given reference 18, in fact constitutes the movable disconnector contact of the device, and it is slidably mounted in the second stationary support 6 of the device so that the device is also movable in translation along the axis AX.

This second stationary support 6 thus comprises, just like the first, a tubular portion 21 having an end that is closed by a flat end wall 22. The movable contact of the disconnector 18 comprises a tubular body 23 that is slidably mounted inside the tubular portion 21 of the stationary support 6. A sliding contact 24 mounted on the inside face of the tubular portion 21, in the region of its end, ensures continual electrical contact between the stationary support 6 and the movable disconnector contact 18.

In the same manner, in the region of its end that is close to the movable permanent contact 17, i.e. the end extending towards the first stationary support 4, the tubular body 23 carries a sliding contact 26 on its inside face.

Figure 2:
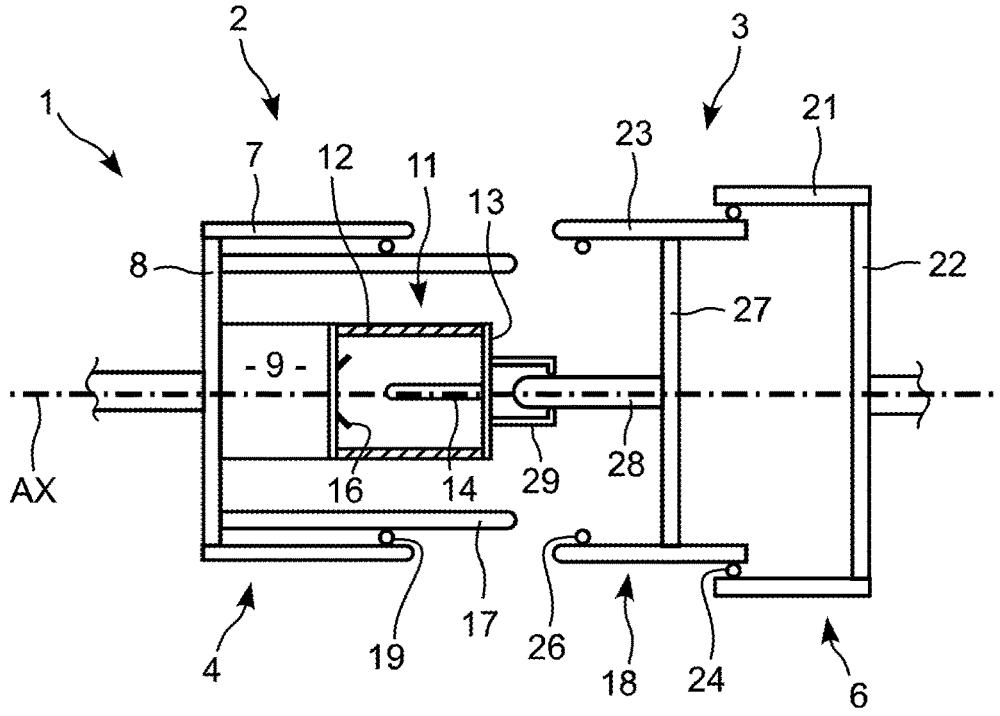
FIG. 2 is a diagrammatic side view in section of the device of the invention when its circuit breaker is open.
Figure 3:
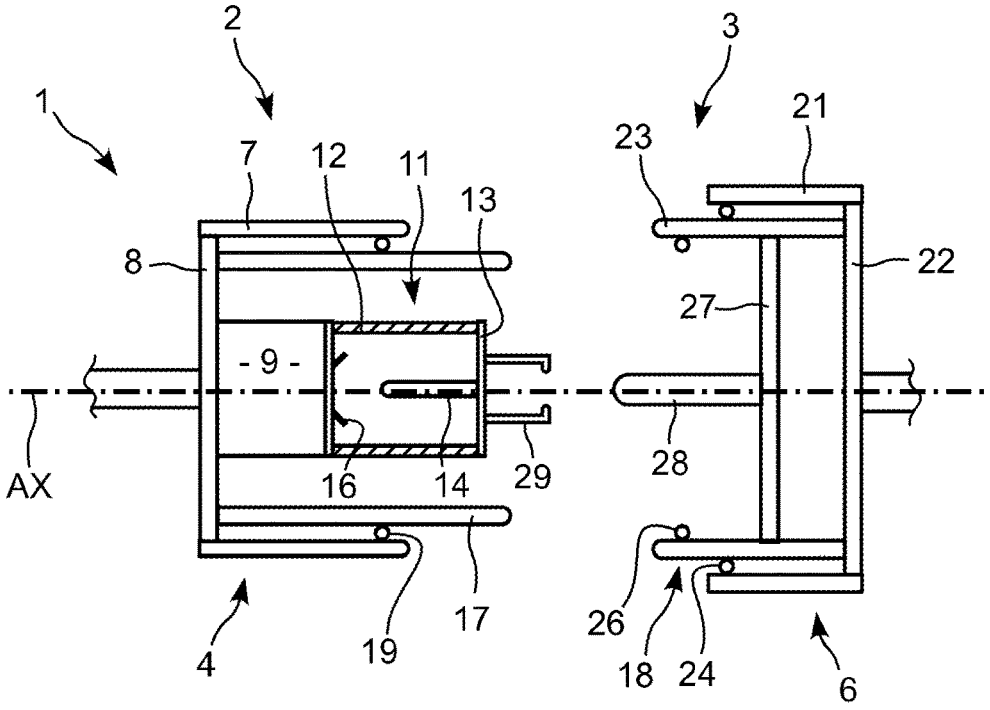
FIG. 3 is a diagrammatic side view in section of the device of the invention when its circuit breaker and its disconnector are open.

This movable disconnector contact 18 is movable in translation between an open position corresponding to the position of FIG. 3 and a closed position corresponding to the position that it occupies in FIGS. 1 and 2.

When it is in its open position, the movable disconnector contact 18 is retracted into the tubular portion 21 in order to be spaced apart from the movable permanent contact 17, regardless of whether it is closed or open. When in its closed position, the movable disconnector contact 18 is deployed so as to come into contact with the movable permanent contact 17 if it is closed, i.e. deployed as in FIG. 1.

Thus, and as can be seen in FIG. 1, when the movable permanent contact 17 is in its deployed closed position, if the movable disconnector contact 18 is also in its deployed closed position, it surrounds the movable permanent contact 17 so as to be in electrical contact with it via the sliding contact 26.

In this situation, the device is completely closed, and the rated current passes successively through the stationary support 4, the movable permanent contact 17, the movable disconnector contact 18, and the second stationary support 6.

In addition to its tubular body 23, the disconnector contact 18 comprises a plane middle wall 27 that extends along a plane that is normal to the axis AX, that closes the tubular body 23, and that carries a central contact pin 28.

This contact pin 28 extends along the axis of revolution AX towards the arc-control shell 11, i.e. away from the second stationary support 6.

In addition to this contact pin 28, the shell end wall 13 carries a tubular contact member 29 on its outside face in which the contact pin 28 comes to engage when the movable disconnector contact 18 is in its closed position as in FIG. 1 or FIG. 2. Under these conditions, the stationary arcing contact 14 of the circuit breaker is electrically connected to the second stationary support 6, by means of the shell end wall 13, the contact member 29, and the movable disconnector contact 18.

As will be understood, in normal operation, the current-interrupter device of the invention is entirely closed, as in FIG. 1. Opening it then consists initially in operating the movable unit including the movable permanent contact 17 and the movable arcing contact 16, to move from its closed position to its open position, namely from left to right in the figures.

In a first stage, the movable permanent contact 17 disconnects from the movable disconnector contact 18. At this point, the entire current passes via the arcing contacts 14 and 16, and via the central pin 28 of the movable disconnector contact 18 in order to reach the stationary support 6.

As this movement continues, the movable arcing contact 16 moves away from the stationary arcing contact 14, and that causes an electric arc to form between these two elements. The arc is then extinguished as the movable arcing contact 16 continues to move away, and this movement ends when it reaches its maximum opening position, as in FIG. 2.

At this stage, the current is interrupted because the movable permanent contact 17 and the disconnector contact 18 are spaced apart from each other and the movable arcing contact 16 and the stationary arcing contact 14 are also spaced apart from each other.

To end electrical opening of the device, it is still advisable to operate the movable disconnector contact 18 until it reaches its open position in order to space it as far apart as possible from the part forming the circuit breaker so as to ensure maximum breaking strength, which corresponds to the situation in FIG. 3.

Figure 4:
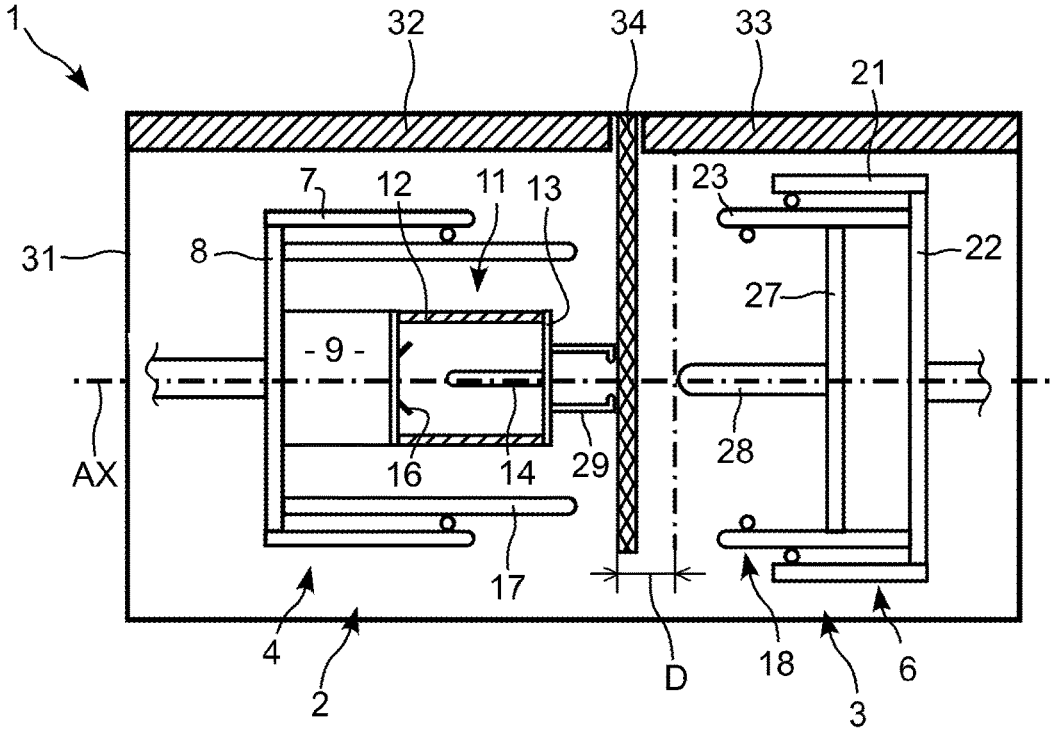
FIG. 4 is a diagrammatic side view in section of the device of the invention installed in an enclosure.

As can be seen in FIG. 3, in the fully open situation of the device, the various components of the circuit breaker part of the device and the various components of the disconnector part of the device are all spaced apart from one another, by at least a minimum distance given reference D in FIG. 4.

There thus remains a gap between these two parts, of length D along the direction AX, thereby leaving a gap that is sufficient for inserting a screen making it possible to increase dielectric strength even further. This thus makes it possible to carry out human intervention on one of the parts of the device, while the other part can be left live.

For this reason, FIG. 4 shows the incorporation of a current-interrupter device of the invention in an enclosure comprising a casing 31 having its top portion closed by two half-roofs 32 and 33 which respectively cover the part 2 forming a circuit breaker and the part 3 forming a disconnector.

These two half-roofs may be opened independently of each other, and they are spaced apart from each other along the axis AX by a slot of narrow width allowing an electric screen 34 to be inserted before opening one or the other of the roofs. This slot makes it possible to insert the screen, but it is sufficiently narrow to prevent a technician from passing an arm or a leg.

An intervention on the circuit breaker part of the device thus consists in ensuring the circuit breaker part is dead, and inserting the electric screen 34 between the two half-roofs, while leaving the disconnector part live. The half-roof 32 covering the circuit breaker part can then be opened in order to make it possible for an operator to intervene on the circuit breaker without risk of electrocution.

In concrete terms, the screen that is inserted along the circuit breaker part ensures that, during an intervention by an operator, a sufficient distance, namely at the distance D, is maintained between all the components of the circuit breaker part and all the components of the disconnector part.

The invention thus provides the following advantages: in the event of damage to the controls of the circuit breaker part, the disconnector-forming part remains operational and may be operated independently of the other part.

Although the device of the invention unites a circuit breaker and a disconnector, it thus enables them to be operated independently. It is thus possible to perform operating tests risk on the circuit breaker part without risk, simply by leaving the disconnector part open, e.g. before the system is commissioned.

By means of the gap being established between the circuit breaker part and the disconnector part when the device is open, it is possible to insert a screen in order to intervene on one of the parts of the device without having to ensure the other part is dead.

What is claimed is:

1. A current-interrupter device (1) comprising a circuit breaker (2) including a first stationary conductive support (4) carrying both a stationary arcing contact (14) and a movable arcing contact (16) that is movable between a closed position and an open position, and also carrying a movable permanent contact (17) that is movable between a closed position and an open position, the movable arcing contact (16) and the movable permanent contact (17) being dynamically linked together by forming a single movable unit and being electrically connected to the first stationary conductive support (4), and a disconnector (3) including a second stationary conductive support (6) carrying a disconnector contact (18) that is movable between a closed position and an open position, and wherein:

the movable disconnector contact (18) is electrically connected with the stationary arcing contact (14) when the movable disconnector contact (18) is in its closed position;

the movable disconnector contact (18) is spaced apart from the stationary arcing contact (14) when the movable disconnector contact (18) is in its open position;

the movable disconnector contact (18) and the movable permanent contact (17) are electrically connected to each other when they are both in their respective closed positions;

the movable disconnector contact (18) and the movable permanent contact (17) are spaced apart from one another when the movable disconnector contact (18) is in its open position; and the movable disconnector contact (18) and the movable permanent contact (17) are spaced apart from one another when the movable permanent contact (17) is in its open position.

2. A device according to claim 1, wherein the movable arcing contact (16) and the movable permanent contact (17) are arranged in such a manner that when the movable disconnector contact (18) is closed, during a movement of the movable arcing contact (16) and the movable permanent contact (17) from the closed position to the open position, the movable permanent contact (17) is disconnected from the movable disconnector contact (18) before the movable arcing contact (16) disconnects from the stationary arcing contact (14).

3. A device according to claim 1, wherein the permanent movable contact (17) has a hollow body of revolution about an axis AX that corresponds to a longitudinal axis of the device, said hollow body surrounding the stationary arcing contact (14) and the movable arcing contact (16) while being slidably mounted relative to the first stationary support (4) that carries the permanent movable contact (17).

4. A device according to claim 3, wherein the movable disconnector contact (18) has a body of revolution and is slidably mounted relative to the second movable support (6) by including a tubular portion (23) for connection to the permanent movable contact (17) and a central pin (28) for connection to the stationary arcing contact (14).

5. A device according to claim 1, wherein firstly the components of the circuit breaker (2) and secondly the components of the disconnector (3) are spaced apart when all of the contacts (14, 16, 17, 18) are open by a distance (D) that allows a screen to be inserted between the circuit breaker and the disconnector.

6. A device according to claim 5, fitted with a screen that is inserted into the gap separating the components of the circuit breaker (2) and the components of the disconnector (3) when the contacts are open.

* * * * *